US009257268B2

(12) United States Patent
Murray et al.

(10) Patent No.: US 9,257,268 B2
(45) Date of Patent: Feb. 9, 2016

(54) IMAGING MASS SPECTROMETER AND A METHOD OF MASS SPECTROMETRY

(71) Applicant: Micromass UK Limited, Wilmslow (GB)

(72) Inventors: Paul Murray, Manchester (GB); Jeffrey M. Brown, Cheshire (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/366,903

(22) PCT Filed: Dec. 20, 2012

(86) PCT No.: PCT/GB2012/053215
§ 371 (c)(1),
(2) Date: Jun. 19, 2014

(87) PCT Pub. No.: WO2013/093482
PCT Pub. Date: Jun. 27, 2013

(65) Prior Publication Data

US 2014/0361162 A1 Dec. 11, 2014

(30) Foreign Application Priority Data

Dec. 23, 2011 (GB) ..... 1122309.6

(51) Int. Cl.

| | |
|---|---|
| ***H01J 49/00*** | (2006.01) |
| ***H01J 49/16*** | (2006.01) |
| ***H01J 49/40*** | (2006.01) |
| ***H01J 49/04*** | (2006.01) |

(52) U.S. Cl.
CPC ..... *H01J 49/164* (2013.01); *H01J 49/0004* (2013.01); *H01J 49/0418* (2013.01); *H01J 49/40* (2013.01); *H01J 49/405* (2013.01)

(58) Field of Classification Search
CPC ..... H01J 49/00–49/4265
USPC ..... 250/288
See application file for complete search history.

(56) References Cited

U.S. PATENT DOCUMENTS

| | | | | |
|---|---|---|---|---|
| 3,819,941 | A | 6/1974 | Carrico | |
| 5,654,545 | A * | 8/1997 | Holle et al. | 250/287 |
| 6,833,545 | B2 | 12/2004 | Axelsson | |
| 2002/0109085 | A1* | 8/2002 | Hillenkamp | H01J 49/164 250/288 |
| 2003/0155499 | A1* | 8/2003 | Axelsson | H01J 49/009 250/281 |

(Continued)

FOREIGN PATENT DOCUMENTS

| | | | |
|---|---|---|---|
| EP | 2325864 | A1 | 5/2011 |
| GB | 2423187 | A | 8/2006 |
| GB | 2427961 | A | 1/2007 |

OTHER PUBLICATIONS

Caprioli et al., "Molecular Imaging of Biological Samples: Localization of Peptides and Proteins Using MALDI-TOF MS," Anal. Chem. 1997, 69, 4751-4760.

(Continued)

*Primary Examiner* — Phillip A Johnston
(74) *Attorney, Agent, or Firm* — Micromass UK Limited

(57) ABSTRACT

An imaging mass spectrometer comprising an energy source adapted to substantially simultaneously provide energy to multiple spots on a sample to produce ions from the sample by a desorption process; and an analyzer adapted to detect the arrival time and spot origin of ions resulting from said desorption process.

20 Claims, 3 Drawing Sheets

(56) References Cited

U.S. PATENT DOCUMENTS

| | | | | |
|---|---|---|---|---|
| 2009/0159789 | A1* | 6/2009 | Yamaguchi | H01J 49/0004 250/281 |
| 2011/0139973 | A1 | 6/2011 | Bowdler | |

OTHER PUBLICATIONS

Luxembourg et al., "High-Spatial Resolution Mass Spectrometric Imaging of Peptide and Protein Distributions on a Surface," Anal. Chem. 2004, 76, 5339-5344.

Trimpin, Sarah, "A Perspective on MALDI Alternatives-Total Solvent-Free Analysis and Electron Transfer Dissociation of Highly Charged Ions by Laserspray Ionization," J. Mass Spectrometry, 2010, 45, 471-485, (www.interscience.com).

Ehring, et al., "Photochemical Versus Thermal Mechanisms in Matrix-Assisted Laser DesorptionIlonization Probed by Back Side Desorption," Rapid Communications in Mass Spectrometry, 1996, vol. 10, 10, 821-824.

Zavalin et al., "Transmission Geometry "Point-and-Shoot" Profiling and Sub-Cellular Imaging Mass Spectrometry with 1 i m Spatial Resolution," 2011, ASMS Poster.

* cited by examiner

IMAGING MASS SPECTROMETER AND A METHOD OF MASS SPECTROMETRY

This application is the National Stage of International Application No. PCT/GB2012/053215, filed on Dec. 20, 2012, which claims priority to and benefit of United Kingdom Patent Application No. 1122309.6, filed Dec. 23, 2011. The contents and teachings of each of these applications are hereby expressly incorporated herein by reference in their entirety.

The present invention relates to an imaging mass spectrometer and a method of mass spectrometry. More specifically, but not exclusively, the present invention relates to an imaging mass spectrometer which allows multiple spots of a sample to be analyzed at the same time and a method employing such a mass spectrometer.

It is often useful to know the different compositions of a sample at various different spots across the sample. For example, in the case of biological tissue, this may be a way of identifying areas within the sample which may be responsible for control of different functions for the subject.

A good way of performing this analysis is often by Matrix Assisted Laser Desorption Ionisation (MALDI) imaging, where a user may fire a laser at one spot on the sample on a sample plate, and analyse the ions that are desorbed from that point on the sample. The ions produced may then be analysed by a mass spectrometer to indicate the content of the sample at that point. If one wishes to determine the composition of the whole of the sample then it is typically necessary to make multiple measurements at spaced apart spots. For a large sample this can be time consuming. This is undesirable as there is often competition for time on expensive mass spectrometers. Therefore, any way of reducing the analysis time required for a sample would be advantageous.

It would therefore be desirable to provide a method of mass spectrometry and a mass spectrometer that is capable of parallel analysis of multiple spots upon a sample, resulting in an increase in sample throughput within the instrument.

Accordingly, in a first aspect, the present invention provides an imaging mass spectrometer comprising:

- an energy source adapted to substantially simultaneously provide energy to multiple spots on a sample to produce ions from the sample by a desorption process; and
- an analyser adapted to detect the arrival time and spot origin of ions resulting from said desorption process.

Preferably, the analyser is adapted to detect ions produced by the desorption process.

Alternatively, or additionally, the analyser is adapted to detect daughter ions produced by the decay of ions produced by the desorption process.

The energy source can be a laser.

Desorption of the ions can occur by Matrix Assisted Laser Desorption Ionisation.

Advantageously, the energy source is adapted to provide energy at an angle substantially perpendicular to the surface of the sample at each of the respective spots.

Preferably, the spectrometer comprises a sample plate for receiving the sample.

Conveniently, the energy source is adapted to provide energy on the sample through the sample plate.

The sample plate can be optically transparent.

The imaging mass spectrometer according to the invention can further comprise a microlens array, the microlens array being adapted to receive the energy from the energy source and provide it at multiple spots on the sample.

The imaging mass spectrometer can further comprise an homogeniser between the energy source and microlens array.

The analyser can comprise a TOF.

The analyser can comprise at least one focussing electrode for providing focussed ions to the TOF.

Said at least one focussing electrode can be at least one grid electrode.

Said at least one focussing electrode can be a gridless electrode.

The analyser can further comprise a detector for detecting the arrival time and position of ions from the time of flight tube (TOF).

The detector can comprise an MCP array detector.

The detector comprises a delay line detector.

Said analyser can further comprise a reflectron.

The energy source can be adapted to provide first and second pulses, one of the pulses being a high energy pulse and the other pulse being a low energy pulse.

In a further aspect of the invention there is provided a method of imaging mass spectrometry comprising the steps of

- providing a sample;
- providing energy to multiple spots on the sample substantially simultaneously to produce ions from the sample by a desorption process; and,
- detecting the arrival time and spot origin of ions resulting from the desorption process.

The step of detecting the arrival time and spot origin can comprise detecting the arrival time and spot origin of ions produced by the desorption process.

The step of detecting the arrival time and spot origin can comprise detecting the arrival time and spot origin of daughter ions produced by the decay of ions produced by the desorption process.

Preferably, the sample is provided on a sample plate and said energy is provided to the sample through the sample plate.

The energy can be provided by a laser.

Preferably, the desorption of ions occurs by Matrix Assisted Laser Desorption Ionisation.

Conveniently, energy is provided to said multiple spots at an angle substantially perpendicular to the surface of the sample.

The energy can be provided to the sample through a microlens array.

Preferably, the step of analysing the arrival time and spot origin comprises the steps of proving the ions or daughter ions to a TOF and then to a detector.

The method can further comprise the step of focussing the ions by means of an electrode before providing them to the TOF.

The step of providing energy can comprise the steps of providing energy in first and second pulses, one pulse being a low energy pulse and the other pulse being a high energy pulse.

The present invention will now be described by way of example only and not in any limitative sense with reference to the accompanying drawings in which.

Figure 5:
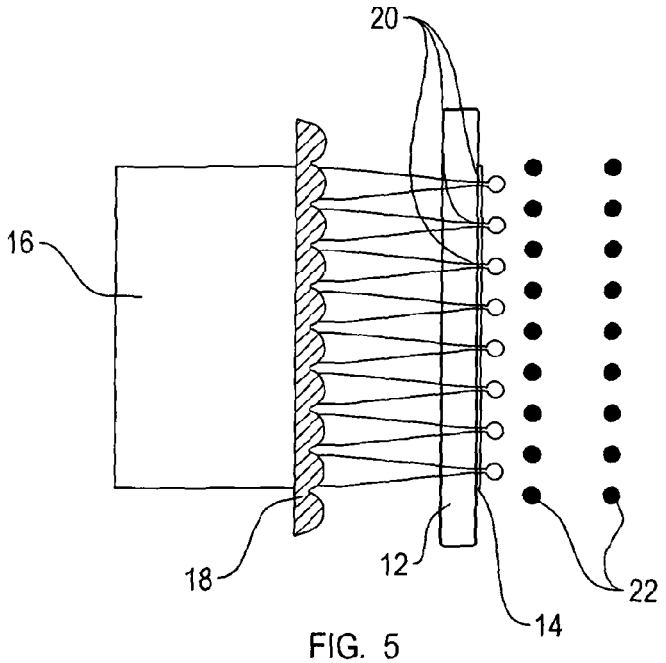
Figure 6:
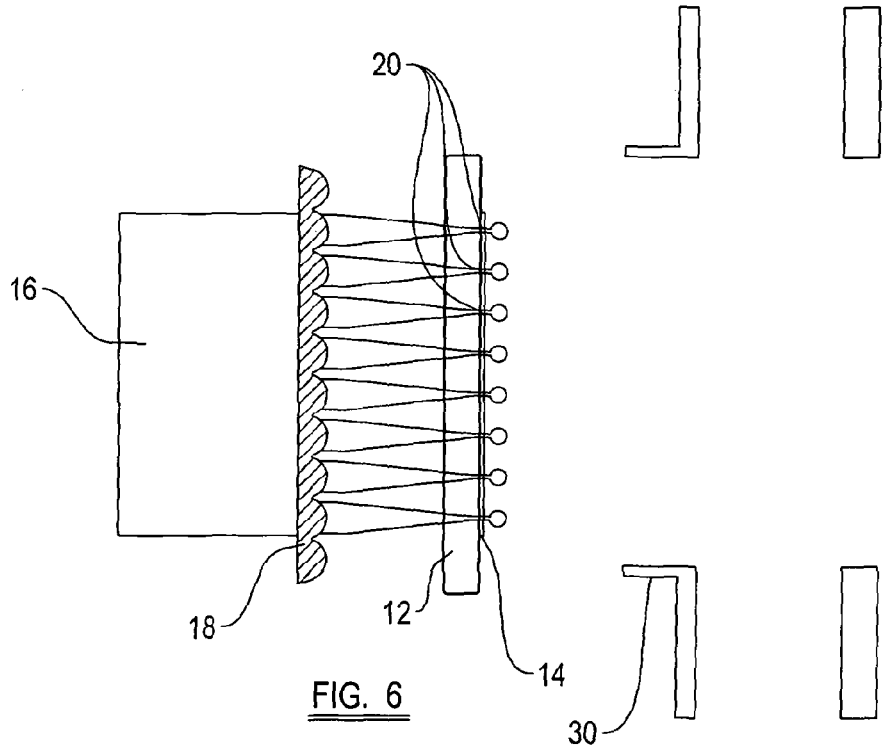

FIG. 5 shows a microlens array, sample plate and focussing electrode of a further embodiment of an imaging mass spectrometer according to the invention; and FIG. 6 shows a microlens array, sample plate and focussing electrode of a further embodiment of an imaging mass spectrometer according to the invention The present invention relates to an apparatus and method for performing Imaging Mass Spectrometry. The methods and devices of the present invention have particular application in the field of MALDI Mass Spectrometry, with the understanding that embodiments of the present invention have utility for performing Imaging mass spectrometry using imaging ion sources other than MALDI.

Figure 1:
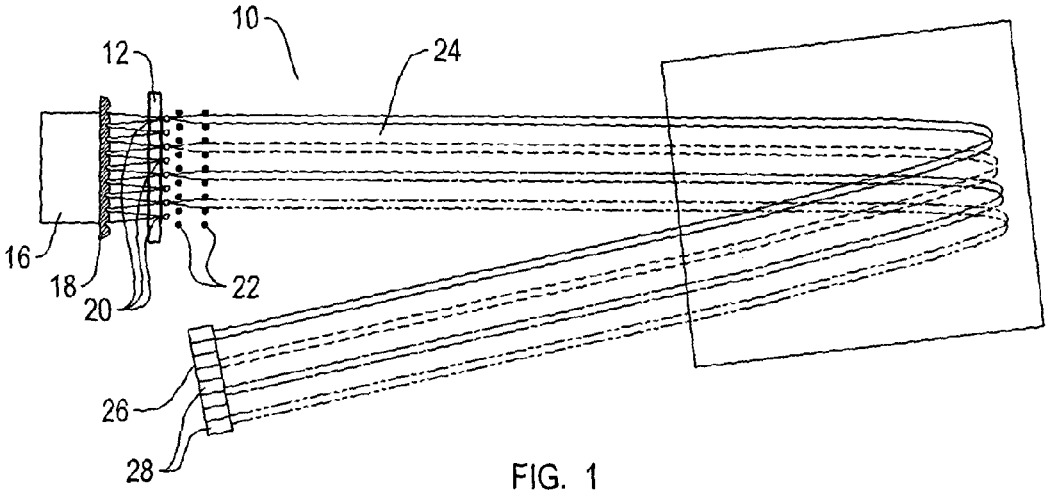
FIG. 1 shows a schematic view of an embodiment of an imaging mass spectrometer according to the invention.

FIG. 1 shows a schematic view of an imaging mass spectrometer 10 according to the invention. The imaging mass spectrometer 10 comprises a sample plate 12. A sample 14 is arranged on the top surface of the plate. An energy source 16 (in this case a laser) is pulsed to irradiate a microlens array 18 positioned to the rear of the sample plate 12 to produce an array of focused laser light which passes through the optically transparent sample plate 12 and irradiates defined spots 20 upon the sample 14. These desorb and ionise ions from the top the surface of the sample 14. The ions then move away from the sample plate 12 in a generally perpendicular direction to the plate 12 into the analyser which detects the spot source and time of arrival of these ions.

The analyser of the mass spectrometer according to the invention comprises a plurality of focussing electrodes 22. The focussing electrodes are arranged to confine the ions into independent paths according to which defined point on the sample plate they have been desorbed from.

The analyser further comprises a TOF 24 (Time Of Flight Tube) and a detector 26. At a predefined time after the laser was pulsed, a voltage is provided across the region in which the ions are travelling and is arranged to pulse the ions on their independent paths into the TOF, The ions which exit the TOF are received by the detector. Ions will arrive at the detector according to their mass to charge ratio. The ions produced from a given spot on the sample all hit the detector at the same known point or region 28. Ions produced from a different spot on the sample hit the detector at a different point or region 28.

Figure 2:
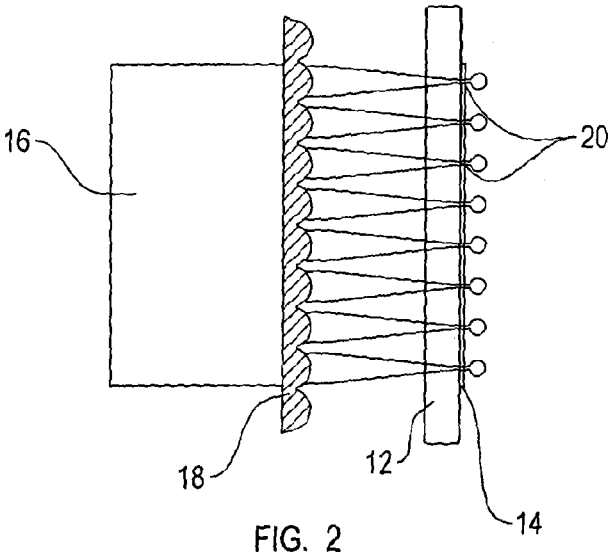
FIG. 2 shows a microlens array and sample plate of a further embodiment of an imaging mass spectrometer according to the invention.

FIG. 2 shows a microlens array 18 and sample plate 12 of an imaging mass spectrometer according to the invention. In this embodiment, a sample plate 12 is provided with a sample substrate 14 placed on the top surface of the plate 12. A laser 16 is pulsed to irradiate a homogeniser (not shown), placed between the laser 16 and the sample plate 12 in order to create a uniform light intensity across the laser beam. The beam then irradiates the microlens array 18 positioned to the rear of the sample plate 12 to produce an array of focused laser light beams each of the same intensity. These irradiate the sample at a plurality of spots 20 causing ions to uniformly desorb from the top surface of the sample 14. The analysis of the ions produced by this means would then potentially be similar to that described with relation to FIG. 1.

Figure 3:
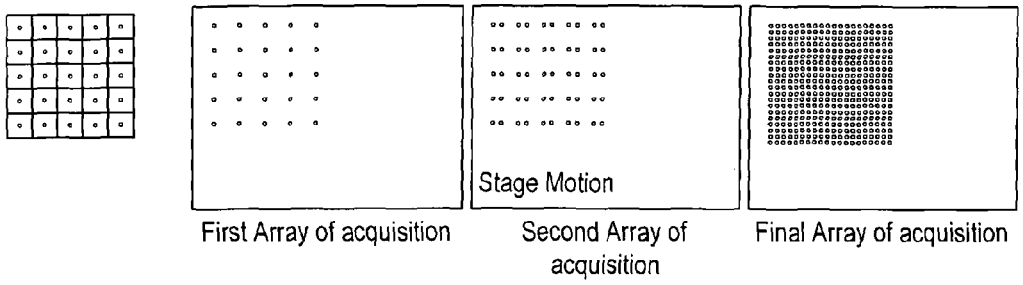
FIG. 3 shows scheme for the interrogation of the sample plate according to the invention.

FIG. 3*a-d* are illustrations of a scheme for the interrogation of the sample plate 12 according to the invention. FIG. 3*a* shows a view of a suitable microlens array 18 in accordance with the invention looking at it from the sample plate 12. Each element on the array is arranged to focus the laser light shining on the back of it, on to a precise defined spot point on the back of the plate 12 as shown in FIG. 3*b*, in order to provide ionisation and desorption off the top surface. The laser 16 can be fired as many times as desired on the defined spots on the sample plate 12.

After analysing the ions produced from the first defined spot points 20 on the sample plate 12, the sample plate 12 can be moved to interrogate a second set of spot points 20 on the plate 12. The position of the second spot points 20 is shown in FIG. 3*c*. They can be analysed in the same way as described for the first spot points. After interrogating the entire sample of interest, an array of acquisitions as shown in FIG. 3*d* can have been performed.

Figure 4:
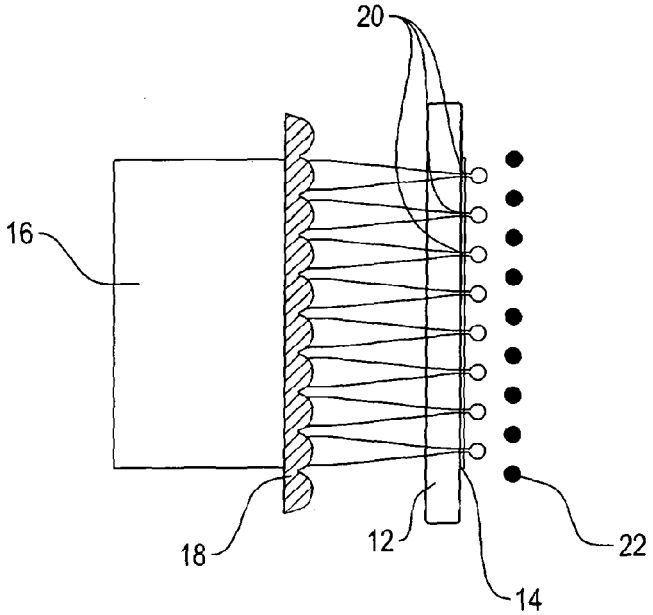
FIG. 4 shows a microlens array, sample plate and focussing electrode of a further embodiment of an imaging mass spectrometer according to the invention.

FIG. 4 shows a microlens array 18, sample plate 12 and focussing electrode 22 of a further embodiment of an imaging mass spectrometer according to the invention. This figure illustrates one method of focussing the ions produced from the sample plate 12 to ensure that the ions from each defined spot points 20 on the sample plate are kept in separate beams. In the embodiment of FIG. 4, the laser 16 shines through the microlens array 18 onto the back of the sample plate 12 at the predefined spot points 20. When the sample on the sample plate 12 is desorbed and ionised, the ions move away from the plate 12 in a generally perpendicular direction to the plate. The grid electrodes 22 focus the ions into beams according to the defined spot 20 on the sample plate 12 that the ions originate from.

At a predefined time after the laser 16 was pulsed, a voltage is provided across the region in which the ions are travelling and is arranged to pulse the ions on their independent paths into a time of flight tube, towards a detector. Ions will arrive at the detector according to their mass to charge ratio. The ions produced from each given point on the sample plate 12 are arranged to hit the detector at the same known point to indicate the defined spot point of origin of the ions.

FIG. 5 shows a microlens array 18, sample plate 12 and focussing electrodes 22 of a further embodiment of an imaging mass spectrometer according to the invention. This figure illustrates an alternative method of focussing the ions produced from the sample on the sample plate 12 to ensure that the ions from each defined spot 20 on the sample plate 12 are kept in separate beams according to one aspect of the invention. In FIG. 5, the laser 16 shines through the microlens array 18 onto the back of the sample plate 12 at the predefined spot points 20. When the sample on the sample plate 12 is desorbed and ionised, the ions move away from the plate in a generally perpendicular direction to the plate 12. In this embodiment, the multiple grid electrodes 22 focus the ions into beams according to the defined spot on the sample plate 12 that the ions originate from.

At a predefined time after the laser 16 was pulsed, a voltage is provided across the region in which the ions are travelling and is arranged to pulse the ions on their independent paths into a time of flight tube, towards a detector. Ions will arrive at the detector according to their mass to charge ratio. The ions produced from each given point on the sample plate are arranged to hit the detector at the same known point to indicate the defined spot point of origin of the ions.

FIG. 6 shows a microlens array 18, sample plate 12 and focussing electrode 22 of a further embodiment of an imaging mass spectrometer according to the invention. This figure provides an illustration of a further method of focussing the ions produced from the sample plate 12 to ensure that the ions from each defined spot points 20 on the sample plate 12 are kept in separate beams. In FIG. 6, the laser 16 shines through the microlens array 18 onto the back of the sample plate 12 at the defined spot points 20. When the sample 14 on the sample plate 12 is desorbed and ionised, the ions move away from the plate in a generally perpendicular direction to the plate. In this embodiment, gridless electrodes 30 focus the ions into beams according to the defined spot 20 on the sample plate 12 that the ions originate from.

At a predefined time after the laser 16 was pulsed, a voltage is provided across the region in which the ions are travelling and is arranged to pulse the ions on their independent paths into a time of flight tube, towards a detector. Ions will arrive at the detector according to their mass to charge ratio. The ions produced from each given point on the sample plate are arranged to hit the detector at the same known point to indicate the defined spot point of origin of the ions.

Ionisation may in particular be performed by MALDI ionisation. It would be apparent to a person skilled in the art that the alternative ionisation techniques may be interchangable to perform the invention without undue experimentation or modification of the techniques. Any form of the provision of energy in multiple spatially discreet locations through a sample plate 12 to perform surface desorption and ionisation would be suitable to perform some embodiments of the invention.

In some embodiments the source of energy may be a laser 16. Examples of suitable lasers include ND:YAG lasers, CO2 lasers, N2 lasers, solid state lasers and gas lasers.

A homogeniser in accordance with some embodiments of the invention may be any known homogeniser, examples of suitable homogenisers are known within the art. An Example of suitable homogenisers include Edmund optics' Techspec® continuously variable apodizing filters. It would be apparent to the skilled person that many other homogenisers may be suitable for use with the invention.

A microlens array 18 in accordance with the invention may be a square filled array or an unfilled array. Examples of suitable arrays for the purposes of this invention may be found from Edmund optic's microlens array range, or similarly from Thorlab's microlens array range.

Typically the energy source provides pulses of energy to the sample. A single energy pulse is split into multiple pulses which are simultaneously provided to the sample. In the preferred embodiment where the energy source is a laser the microlens array splits a pulse from the laser into multiple pulses which are simultaneously incident on the sample.

In alternative embodiments of the invention the energy source may for example comprise a plurality of lasers. In such embodiments the pulses are timed to be incident on the sample substantially simultaneously such that the resulting ions can be pulsed into the flight tube with the same pulse.

The advantage of homogenising the laser beam to create a uniform intensity of laser beam is that it results in the laser intensity supplied to each spot point 20 on the sample plate 12 being substantially the same. This should allow for relative quantitation to be performed on the sample 14. If the intensities of the laser light were varied between spots it would be substantially more difficult to perform any quantitative analysis of the sample.

In some embodiments of the invention the sample plate 12 may be a transparent plate, envisaged materials for the plate may include, but are not limited to glass, perspex, plastics or silica. In less preferred embodiments, particularly where the source of energy is not a laser, the sample plate may be a metal or a ceramics material.

In some embodiments of the invention the sample plate 12 may be relatively thin, in some embodiments the sample plate 12 may in the range of 0.1 mm to 5 cm. In embodiments of the invention where laser energy is used, the sample plate 12 must be thinner than the focal length of the microlens array 18.

In some embodiments the sample 14 may be a biological sample, other types of samples may include polymers, paint films and inks.

In a preferred embodiment the sample 14 may have a matrix upon, or mixed in with the sample. In the preferred embodiment the sample will have matrix upon the surface to allow for MALDI ionisation to occur at the time or after desorption of the sample from the sample plate 12 in MALDI ionisation mechanisms.

In one embodiment one or more grid electrodes 22 could be used to focus the ions that are travelling from the sample plate 12 to avoid them diverging on the way to the detector. In some embodiments the grid electrodes 22 may be used to act as a pusher for a time of flight tube 24 and subsequent detector 26.

In the embodiment including two grid electrodes 22, the sample plate 12 or a sample plate holder may be held at a high voltage, and the first grid electrode 22 also held at the same, high voltage with the second grid electrode 22 held at ground. Upon pushing the ions into the ToF tube, the voltage on the first grid electrode may be dropped to produce a pulse which pushes the ions out of the region containing the grid electrodes 22 into the flight tube 24 and to the detector 26.

In the embodiment including one grid electrode 22, the sample plate 12 or a sample plate holder may be held at a high voltage, and the grid electrode 22 also held at the same, high voltage with the flight tube 24 held at ground. Upon pushing the ions into the ToF tube 24, the voltage on the grid electrode 22 may be dropped to produce a pulse which pushes the ions out of the region containing the grid electrodes into the flight tube 24 and to the detector 26.

Preferably the apparatus may use a delayed extraction mode of operation to correct for differences in the velocity of ions that are desorbed from the sample plate 12. A person skilled in the art would understand this to mean that a delay between the timing of the laser pulse and the pulsing of ions out of the ion source into the flight tube 24 is created. It would be apparent to the skilled person that this would allow greater mass resolution for the instrument.

In one embodiment the analyser is a linear ToF. In a second embodiment the time of flight analyser is a reflectron ToF.

In one embodiment the detector 26 is a MCP array detector, in one embodiment the MCP array detector has an array of MCPs corresponding to the elements of the microlens array and hence, the spot points 20 on the sample plate 12. In the preferred embodiment each MCP detector will receive ions from it's corresponding spot point 20 on the sample plate 12 to produce a spectrum from each MCP for each corresponding sample spot.

In a second embodiment the detector 26 may be a delay line detector. A known delay line detector that may be suitable for use in this embodiment is the Kratos axis nova delay line detector. A delay line detector is capable of providing a single pulse counting detector which can give both Flight time data and positional data for any ion which reaches the detector. A typical delay line detector comprises a multi-channel plate stack above two orthogonal delay-line anodes and associated electronic control units to deconvolute the information provided by the data to produce imaging information.

In a further embodiment of the invention Post Source Decay may be encouraged within analyser, such that both parent and daughter ions may be produced for ions from each spot. By increasing the laser intensity, ions can be encouraged to decay after ionisation. This can be used to provide daughter ion spectra as well as parent ion spectra from the sample at the same time.

In a PSD enabled embodiment, a reflectron system would be preferred, although a ToF-ToF instrument may also be used.

In a PSD experiment, in one embodiment a detector 26 may be arranged to detect the position and flight time of the parent ions as previously, but also measure the flight time and position of impact of daughter ions that have been produced by the fragmentation of these parent ions. The position of impact and the time of flight of the daughter ions can be measured, and by deconvolution of the data, a daughter ion mass, and the relative position that daughter ion had originated from may be determined.

In one embodiment PSD can be performed using a delay line detector. In this instance the precise position can be used to give better positional information for the daughter ions. This may lead to better mass resolution. In a second embodiment PSD can be performed using a multi array detector.

In a further embodiment, the laser 16 may be switched between a first low intensity of laser light in a first mode to a second high intensity laser light in a second mode to produce a spectrum of substantially parent ions in said first mode and a spectrum of substantially daughter ions in the second mode.

It would be appreciated that the application is drafted to specify MALDI Imaging. It would be appreciated that although the apparatus may be specifically designed to allow the performance of MALDI imaging experiments, a user could perform MALDI without imaging information. Similarly, the imaging function may be disabled using this same apparatus. It would also be appreciated that this invention may apply to different types of ionisation including piezoelectric excitement, Surface enhanced laser desorption (SELDI) and secondary ion mass spectrometry (SIMS).

In embodiments described herein, the mass spectrometer comprises a sample plate for receiving the sample, and energy is provided through the material of the sample plate. In another embodiment, the sample plate may comprise a least one aperture through which the energy is provided to the sample. In another embodiment, the sample may be held in a sample holder, without the need for a sample plate.

In embodiments described herein, energy is provided through the sample plate to one side of a sample, and the ions are produced from the other side of the sample. Alternatively, it is envisaged that the energy source and analyser could be provided facing the same side of the sample, each at an angle to the normal from the surface of the sample.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An imaging mass spectrometer comprising:

an energy source adapted to substantially simultaneously provide focused beams of energy to multiple spots on a sample to produce ions from the sample by a desorption process;

an analyser adapted to detect the arrival time and spot origin of ions resulting from said desorption process; and a sample plate for receiving the sample, wherein the energy source is adapted to provide energy on the sample through the sample plate at an angle substantially perpendicular to the surface of the sample at each of the respective spots.

2. An imaging mass spectrometer as claimed in claim 1, wherein the analyser is adapted to detect at least one of ions produced by the desorption process and daughter ions produced by the decay of ions produced by the desorption process.

3. An imaging mass spectrometer as claimed in any claim 1, wherein the energy source is a laser.

4. An imaging mass spectrometer as claimed in claim 1, wherein desorption of the ions occurs by Matrix Assisted Laser Desorption Ionisation.

5. An imaging mass spectrometer as claimed in claim 1, wherein the sample plate is optically transparent.

6. An imaging mass spectrometer as claimed in claim 1, further comprising a microlens array, the microlens array being adapted to receive the energy from the energy source and provide it at multiple spots on the sample.

7. An imaging mass spectrometer as claimed in claim 6, further comprising an homogeniser between the energy source and microlens array.

8. An imaging mass spectrometer as claimed in claim 1, wherein the analyser comprises a time of flight tube (TOF) and at least one focussing electrode for providing focussed ions to the TOF.

9. An imaging mass spectrometer as claimed in claim 8, wherein said at least one focussing electrode is at least one grid electrode or a gridless electrode.

10. An imaging mass spectrometer as claimed in claim 1, wherein the analyser further comprises a detector for detecting the arrival time and position of ions from the TOF.

11. An imaging mass spectrometer as claimed in claim 10, wherein said detector comprises one or more of an MCP array detector, a delay line detector, and a reflectron.

12. An imaging mass spectrometer as claimed in claim 1, wherein the energy source is adapted to provide first and second pulses, one of the pulses being a high energy pulse and the other pulse being a low energy pulse.

13. A method of imaging mass spectrometry comprising the steps of providing a sample on a sample plate;

providing focused beams of energy to multiple spots on the sample substantially simultaneously to produce ions from the sample by a desorption process, wherein said focused beams of energy are provided to the sample through the sample plate to the multiple spots at an angle substantially perpendicular to the surface of the sample; and, detecting the arrival time and spot origin of ions resulting from the desorption process.

14. A method as claimed in claim 13, wherein the step of detecting the arrival time and spot origin comprises detecting the arrival time and spot origin of ions produced by the desorption process.

15. A method as claimed in claim 13, wherein the step of detecting the arrival time and spot origin comprises detecting the arrival time and spot origin of daughter ions produced by the decay of ions produced by the desorption process.

16. A method as claimed in claim 13, wherein the energy is provided by a laser.

17. A method as claimed in claim 13, wherein desorption of ions occurs by Matrix Assisted Laser Desorption Ionisation.

18. A method as claimed in claim 13, wherein the energy is provided to the sample through a microlens array.

19. A method as claimed in claim 13, wherein the step of analysing the arrival time and spot origin comprises the steps of focussing the ions by means of an electrode, providing the ions or daughter ions to a TOF and then to a detector.

20. A method as claimed in claim 13, wherein the step of providing energy comprises the steps of providing energy in first and second pulses, one pulse being a low energy pulse and the other pulse being a high energy pulse.

* * * * *